US007418851B2

(12) United States Patent
Labro

(10) Patent No.: US 7,418,851 B2
(45) Date of Patent: Sep. 2, 2008

(54) DEVICE FOR CRIMPING A CONTACT ON A CABLE

(75) Inventor: Daniel Labro, L'Isle Jourdain (FR)

(73) Assignee: Airbus France S.A.S., Toulouse (FR)

( * ) Notice: Subject to any disclaimer, the term of this patent is extended or adjusted under 35 U.S.C. 154(b) by 260 days.

(21) Appl. No.: 11/010,758

(22) Filed: Dec. 13, 2004

(65) Prior Publication Data

US 2005/0136736 A1 Jun. 23, 2005

(30) Foreign Application Priority Data

Dec. 11, 2003 (FR) ..... 03 51027

(51) Int. Cl.
*H01R 43/048* (2006.01)
*B21D 39/04* (2006.01)
*B21D 41/04* (2006.01)

(52) U.S. Cl. ..... 72/402; 29/753

(58) Field of Classification Search ..... 72/402; 29/751, 753, 282, 283.5, 237
See application file for complete search history.

(56) References Cited

U.S. PATENT DOCUMENTS 2,409,549 A * 10/1946 Djidics ..... 86/40
3,109,333 A * 11/1963 Anderson ..... 72/402
3,833,993 A * 9/1974 Kremkau ..... 29/753
4,454,657 A * 6/1984 Yasumi ..... 33/644
4,552,002 A * 11/1985 Haenni et al. ..... 72/21.4
4,614,107 A 9/1986 Norin
5,715,723 A * 2/1998 Owens ..... 72/402
5,829,288 A * 11/1998 Serruys ..... 72/17.1
6,360,577 B2 * 3/2002 Austin ..... 72/402
6,606,891 B1 * 8/2003 McGowan et al. ..... 72/21.4
6,840,081 B2 * 1/2005 Kokish ..... 72/402
7,021,114 B2 * 4/2006 Perreault ..... 72/402
7,152,452 B2 * 12/2006 Kokish ..... 72/402

FOREIGN PATENT DOCUMENTS

DE 100 60 165 A 6/2002

* cited by examiner

*Primary Examiner*—Daniel C Crane
(74) *Attorney, Agent, or Firm*—Patterson, Thuente, Skaar & Christensen, P.A.

(57) ABSTRACT

A device for crimping a sleeve of a contact on to a sheath of an electrical cable comprises a diaphragm. The diaphragm applies walls of the sleeve against the sheath. Jaws forming the diaphragm have a generally triangular shape. The crimping device may include means for checking the quality of the crimping of the sleeve on the sheath. For example, the checking means include sensors of the crimping forces as a function of a function of a shift of the jaws. The diaphragm of the crimping device may comprise at least eight jaws. Also disclosed is a sleeve crimped on to a sheath by means of the disclosed crimping device.

13 Claims, 2 Drawing Sheets

DEVICE FOR CRIMPING A CONTACT ON A CABLE

RELATED APPLICATIONS

The present application claims priority to French Application No. 03 51027 filed Dec. 11, 2003.

BACKGROUND OF THE INVENTION

1. Field of the Invention

An object of the invention is a device for crimping a contact on an electrical cable. Certain contacts are crimped at two positions on a cable. A first crimping, called an electrical crimping, is made between the sleeve of said contact and a conductive part of the cable. A second crimp, called a tight-sealing crimp or sealing crimp, is made further upstream between the sleeve of the contact and a sheath of the cable. More specifically, an object of the invention is a crimping device for crimping a sleeve of a contact on to a sheath of an electrical cable.

It is an aim of the invention to enable a tight-sealed or sealed crimping of the sleeve of the contact to a sheath of an electrical cable. Another aim of the invention is to enable the sealed crimping of different cable diameters with a same crimping device. Another aim of the invention is to provide for high sealing quality of the crimping whatever the diameter of the electrical cable.

In electronics, cables are used to connect electronic systems to one another or to an electrical power supply. In general, it is indispensable to ensure the security of these connections. Furthermore, in aeronautics, a connection between a cable and a contact has to be reliable, whatever the external conditions to which it is subjected. For example, in an aircraft, the temperature may vary between −50° C., when it is in the air, and +40° C. when it is on the ground. These temperature variations are undergone within a few hours. Now, high-amplitude temperature and pressure variations should not damage the electrical connections. In particular, the tightly sealed quality of the connection is vital to prevent corrosion. The utility of crimping the elements that come into play in an electrical connection is therefore essential in aeronautics.

2. Description of the Prior Art

To ensure connection quality of this kind, there are dual-crimped contacts in the prior art. A contact has a sleeve with a truncated outer rim. An electrical cable is housed in the sleeve. The sleeve is made of a deformable and conductive material. A bared part of the cable as well as a portion of the cable encased in a sheath are housed in the sleeve. A first crimping operation or electrical crimping operation joins the sleeve of the contact to a core of the cable. The core of the cable designates bared strands of the cable, mainly strands that are not surrounded by the sheath. A second crimping operation or sealing crimping operation provides for the tight sealing of the connection. To this end, the sleeve of the contact is crimped on the sheath of the cable. These two crimping operations are performed simultaneously or one after the other.

To carry out the tightly sealing crimping, a known method consists of the application, in a first stage, of ovalization means on a zone of the sleeve surrounding the sheath. The ovalization means are formed, for example, by two pads. A contact zone of each pad with the sleeve is flat. The two pads forming the ovalization means are applied on either side of the sleeve in order to flatten it. These flattened faces of the sleeve are crimped on to the sheath. In a second stage, once the sleeve has been partially flattened on the sheath, compression means are applied to the two ovoid faces of the sleeve. The compression means are, for example, formed by two pads. Each pad has a contact zone with the sleeve. The contact zone with the sleeve has a contour that follows the ovoid contour of the ovoid faces of the sleeve. The application of the compression means to the sleeve crimps the ovoid faces of the sleeve on the sheath.

Ovalization and compression means of this kind can be used to obtain a tightly sealed crimping of a connection. However, to ensure the tightly sealed quality of this crimping, the contact zone of the compression means must follow the ovoid contour of the sleeve exactly. Now, depending on a diameter of the electrical cable for which a connection has to be made, the ovoid contour of the sleeve obtained after the application of the ovalization means varies. It is therefore necessary to use different compression means for each diameter of the cable to be crimped. Furthermore, it is not possible to check the quality of the tight sealing of the connection made by such crimping means.

The invention seeks to resolve the problems set forth here above by proposing a crimping device that enables the tightly sealed crimping of the contact sleeves to cables of different diameters. The invention also proposes a device to check or control the tightly sealed quality of the crimping achieved.

SUMMARY OF THE INVENTION

To obtain this result, the invention uses a crimping device for which a crimping diameter may vary according to the needs of a user, namely according to a diameter of the cable. The term "crimping diameter" is understood to mean the diameter that the crimping device must impose on the sleeve at the end of the crimping operation. For this purpose, the crimping device of the invention has a diaphragm. The diaphragm of the invention is provided with a plurality of jaws. A variation in the distance of the jaws from a center of the diaphragm modifies a diameter of aperture of said diaphragm. For this purpose, each jaw of the diaphragm is provided with guiding means. The guiding means are formed, for example, by rails along which the jaws slide, so as to approach or move away from the center of the diaphragm. Furthermore, by modifying the number of jaws forming the diaphragm, it is possible to modify a section of said diaphragm. Thus, the greater the number of jaws, the greater the extent to which the section of the corresponding diaphragm will tend toward a circular section. And the more circular the section of the diaphragm, the more tightly sealed are the crimps obtained by means of such a diaphragm.

Thus, for a crimping device of the invention provided with a given number of jaws, it is possible to crimp sheaths of several diameters by varying the diameter of aperture of the diaphragm, in moving the jaws closer to or away from the center of the diaphragm. And by modifying a number of jaws of the device of the invention, it is possible to obtain diaphragms each covering a different range of sheath diameters, so as to enable tightly sealed crimping for all the existing diameters of sheaths.

In one exemplary embodiment of the invention, the jaws have a triangular section. One section of the device of the invention is therefore polygonal and not circular. A sheath of an electrical cable and a sleeve of a contact before crimping generally have a circular section. After the sleeve has been crimped on the sheath by means of the device of the invention, the sleeve has a polygonal section at the position of the crimping. It is therefore necessary, before carrying out a crimping operation, to take account of the tolerance values after the crimping of each sleeve. Each sleeve has a tolerance value ranging between a minimum diameter and a maximum diameter. If the diameter imposed on the sleeve by the crimping is below the minimum diameter, there is a risk that the sleeve may break and that the cable may get weakened. If the diameter imposed by the sheath housed in the sleeve is greater than the maximum diameter, then the sleeve will not be sufficiently restrained and tight sealing cannot be ensured.

Thus, the diameter of aperture of the diaphragm at the end of the crimping of the sleeve around the sheath must take account of these tolerances values to ensure the integrity and tight sealing of the connection.

In the invention, it is possible especially to play on the number of jaws of the diaphragm in order to comply with the requirements of the tolerance values. It is therefore possible to adapt a geometry of the aperture of the diaphragm to the smallest radius of the sleeve to be crimped with this crimping device, in modifying the number of jaws forming the diaphragm, and therefore modifying a minimum aperture diameter of said diaphragm.

In general, once crimped on to the sheath of the cable, the sleeve has a polygonal section.

In one example of an embodiment of the invention, the diaphragm has twelve jaws. The section of the sleeve crimped on the sheath then has a dodecagonal shape.

In another example of an embodiment of the invention, the diaphragm has eight jaws. The section of the sleeve crimped on the sheath then has an octagonal shape.

In one particular exemplary embodiment of the invention, round jaws can be used. The term "round jaws" is understood to mean jaws having a triangular section, but with a least one side having a rounded edge. A radius of curvature of a rounded end of each of the round jaws is pointed toward a center of the diaphragm. Thus, in a closed position, i.e. for a minimum diameter of aperture of the diaphragm, the section of the diaphragm is circular. This diameter corresponds to the minimum diameter that can be crimped with a crimping device of this kind. The crimping obtained with diameters close to this minimum aperture diameter is perfectly sealed. The section of the sleeve, crimped on a sheath having a diameter close to the minimum diameter of aperture of the diaphragm, is circular. For diameters of sheaths to be crimped that are removed from this minimum diameter of aperture, the section of the diaphragm has a polygonal shape with a rounded corners. The section of the sleeve crimped on a sheath in such a case follows an internal contour of the aperture of the diaphragm. Thus, the section of the sleeve crimped on the sheath has a polygonal shape with rounded corners.

A modification of the diameter of aperture of the diaphragm may be commanded by a control device using gears. For example, the gears can be used to make the jaws slide on the rails that they use as guiding means. It is also possible to use a traditional mechanical control device, comprising cams for example.

In one particular example of an embodiment of the invention, it can be planned to provide the crimping device of the invention with means for checking a quality of the crimping, i.e. means to ascertain that the crimping obtained truly corresponds to the expected crimping. The means used to check the crimping quality comprise, for example, force measurement sensors. Each jaw of the diaphragm may thus be provided with a force measurement sensor.

Before a use of a crimping device according to the invention, reference data are memorized in a processor. These reference data may vary as a function especially of the material forming the sleeve of the contact to be crimped on the sheath. Indeed, depending on the material used to make the sheath, the force necessary to shift the jaws, and therefore crush the sleeve on the sheath, will be different. The reference data include different force values to modify the diameter of aperture of the diaphragm from the maximum to the minimum diameter of aperture. The reference data also include the values of the corresponding expected shifts of the jaws for each force value. Thus, a force/shift reference crimping characteristic is obtained in a data memory. This crimping characteristic subsequently serves as a basis for comparison for the processor to check the quality of the crimping achieved by means of the device of the invention.

Thus, at the end of an operation for crimping a sleeve having a given diameter and made of a given material on a sheath of an electrical cable with a given diameter, the processor, as a function of the force exerted on the diaphragm, ascertains that the shift of the jaws obtained corresponds to be expected shift. The processor compares the values given firstly by the force sensor and secondly by the shift sensor with the corresponding values on the crimping characteristic. If the values given by the sensors are identical with the expected values according to the reference characteristic, the crimping is of good quality. The tight sealing of the connection is ensured. Conversely if, for a given force value, the shift of the jaws is greater than the expected shift, it may be that the connection is not perfectly sealed, or that the connection is damaged. For example, it could be that a strand of the electrical cable has been sectioned before or during the tight-sealing crimping. The resistance of the cable to compression by the sleeve would therefore be smaller than expected. Thus, the shift obtained for a given force would be greater than the expected shift.

It is possible to couple an action of the tightly sealed crimping device with an action of the electrical crimping device. The term "electrical crimping" is understood to mean the crimping of the sleeve of the contact on to the core of the cable. For example, a device to control the diameter of aperture of the diaphragm may also actuate the electrical crimping device. This enables a simultaneous or almost simultaneous crimping of the sleeve on the sheath and on the core of the cable. This simultaneous double crimping especially reduces the risks of a shifting of the sleeve along the electrical cable between the electrical crimping and the tight-sealing crimping. Such a shift is, for example, a cause of breakage of one or more strands of the cable. Thus, a double simultaneous crimping reduces the risks of breakage of the cable.

An object of the invention therefore is a device for crimping a sleeve of a contact on a sheath of an electrical cable, wherein the device comprises a diaphragm applying the sleeve against the sheath.

In a particular embodiment of the invention, the diaphragm is formed by jaws, each jaw having a generally triangular section. The term "generally triangular section" is understood to mean a section with three sides formed by three straight lines, but also a three-sided section where at least one of the sides has a rounded section.

The invention also relates to a sleeve of a contact crimped on the sheath of the cable, when the sleeve has a polygonal section.

The invention also relates to a sleeve of a contact crimped on a sheath of a cable, wherein the sleeve has a circular section.

BRIEF DESCRIPTION OF THE DRAWINGS

The invention will be understood more clearly from the following description and the accompanying figures. The figures are given by way of an indication and in no way restrict the scope of the invention. Of these figures.

MORE DETAILED DESCRIPTION

Figure 1:
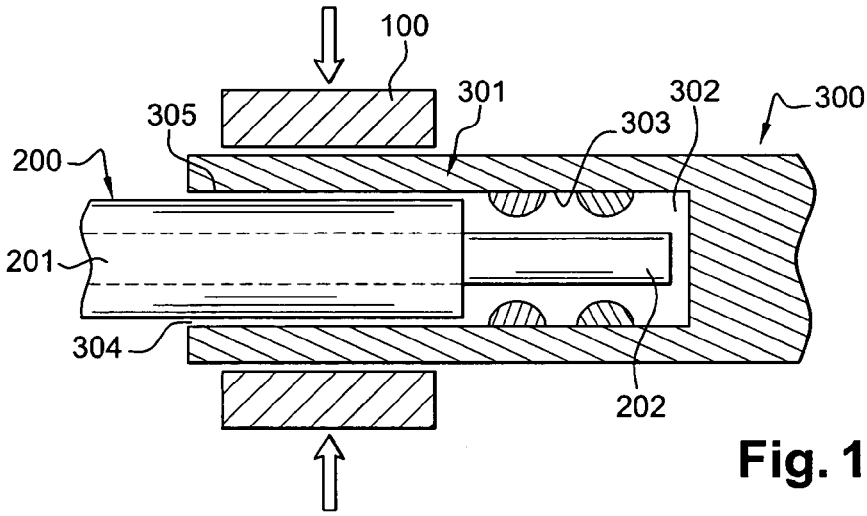
FIG. 1 is a general view of a cable at a connection and of a crimping device of the invention.

FIG. 1 shows a crimping device 100 of the invention. The device 100 partially surrounds a sleeve 301 of a contact 300. In the sleeve 300, an electrical cable 200 is housed. A core 202 of the cable 200 is housed at a closed end 302 of the sleeve 300. Internal walls 303 of the closed end 302 of the sleeve 301 crimp the core 202 of the cable 200. A portion of the cable 200, provided with the sheath 201, is housed in the sleeve 301 at an open end 304 of the sleeve 300.

The crimping device 100 of the invention must enable the crimping of the internal walls 305 of the open end 304 of the sleeve 301 against the sheath 201, so as to tightly seal the connection between the cable 200 and the contact 300.

The crimping device 100 of the invention can adapt to different diameters of cables 200 and sleeves 300. This means that a same crimping device 100 can enable a tightly sealed crimping of different diameters of sleeves 300 and cables 200. To this end, the crimping device 100 of the invention has a diaphragm 101 (FIG. 2).

Figure 2:
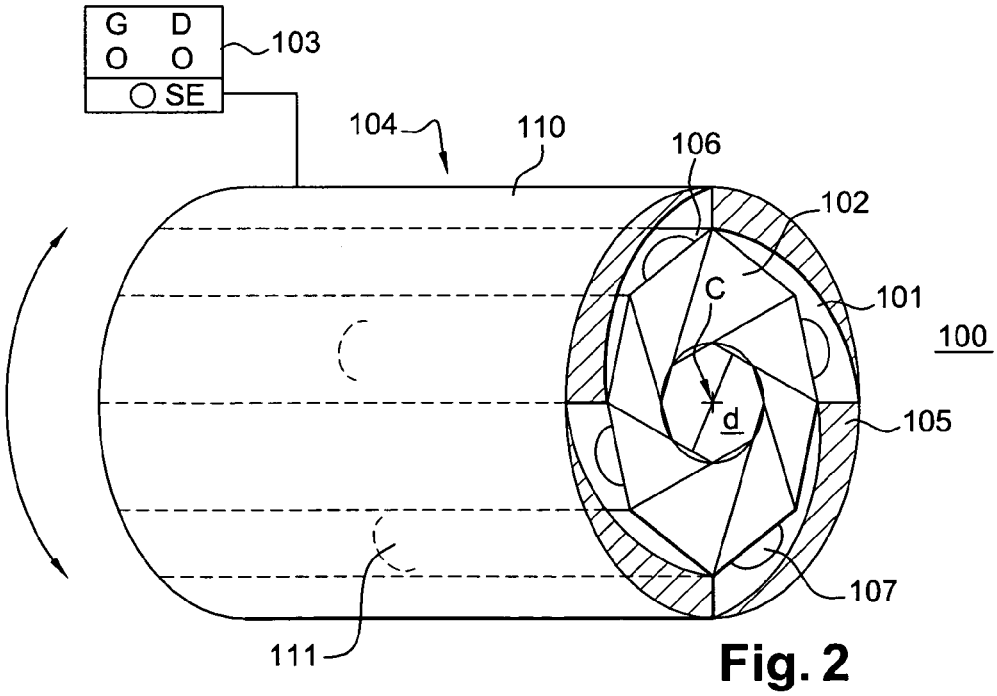
FIG. 2 is a schematic view of a crimping device according to an exemplary embodiment of the invention.

FIG. 2 shows an example of an embodiment of the crimping device 100 of the invention. The diaphragm 101 is formed by eight jaws 102. A shifting of the jaws 102 toward a center C of the diaphragm 101 reduces a diameter d of aperture of said diaphragm 101. Conversely, in moving the jaws 102 away from the center C of the diaphragm 101, the diameter of aperture d of the diaphragm 101 is increased. Depending on the diameter of aperture d of the diaphragm 101, sleeves of different diameters can be crimped on to cables of different diameters.

In the examples shown in FIG. 2, a device 103 for controlling the diameter of aperture d of the diaphragm 101 can be used, as needed by a user, to modify the diameter of aperture d of the diaphragm 101. To this end, the control device 103 actuates a cam-based device 104. The cam-based device 104 is formed by a hollow cylinder 110 in which the jaws 102 of the diaphragm 101 are housed. An internal contour of the cylinder 110 is provided with four upper cams 105 evenly positioned on a circular rim of the cylinder 110. An external face 106 of four first jaws 102 is provided with a boss 107 that comes into contact with the upper cam 105. The internal contour of the cylinder 110 is also provided with four lower cams (not shown in FIG. 2) evenly arranged on the circular rim of the cylinder 110. The lower cams are arranged in a quincunxial arrangement with the upper cams 105. An external face 106 of each of the other four jaws 102 is provided with a boss 111 coming into contact with a lower cam. The jaws 102 provided with a boss 107 at the position of the upper end alternate with the jaws 102 provided with a boss 111 at the position of a lower end. Thus, a cam 105 of the cam-based device 104 enables the simultaneous shift of two attached jaws 102.

An actuation of the control device 103 enables a rotation of the cylinder 104 about the diaphragm 101, making the jaws 102 of the diaphragm 101 shift toward the center C or, on the contrary, in a direction opposite the center C.

The control device 103 is, for example, an electronic device enabling the remote control of the rotation of the cylinder 104 toward the left G or toward the right D, in order to increase or reduce the diameter of aperture d of the diaphragm 101. It can be planned that the control device 103 will also be capable of actuating a device (not shown) for the electrical crimping of the closed end 302 of the sleeve 300 on the bared part 202 of the cable 200. A specific key SE may be planned to this effect on the control device 103.

Figure 3:
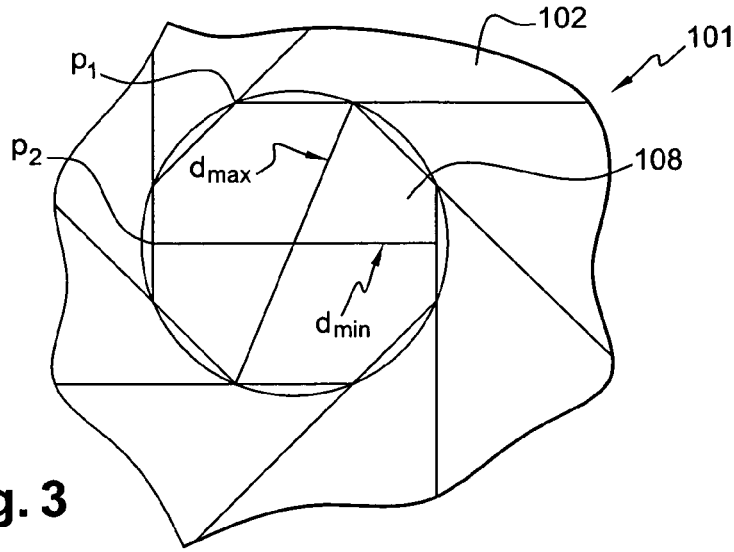
FIG. 3 is a front view of a crimping device according to an exemplary embodiment of the invention.

In a particular embodiment of the invention, and as shown in FIG. 3, the jaws 102 of the diaphragm 101 have a triangular section with plane faces. This means that each side of the triangular section is straight. An aperture 108 of the diaphragm 101 therefore has a polygonal section. Now, the sheath 201 of the cable to be crimped and the sleeve 301 have a circular section. A final diameter of the sleeve 301 at the position of the crimping around the sheath 201 will therefore vary from one point P1 to another point P2 of the crimping. However, a maximum diameter dmax and a minimum diameter dmin of the sleeve 301 at the position of the crimping must remain within a range of tolerance values of the sleeve. Depending on the tolerance values of the sleeve to be crimped, it is possible to provide for a diaphragm 101 with a variable number of jaws 102.

Figure 4A:
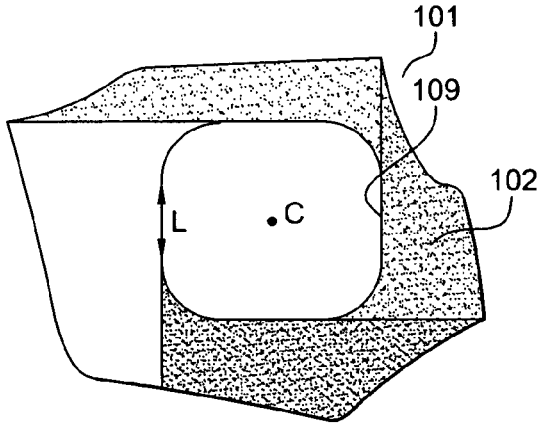
FIGS. 4*a* and 4*b* are two front views of a crimping device according to another exemplary embodiment of the invention.
Figure 4B:
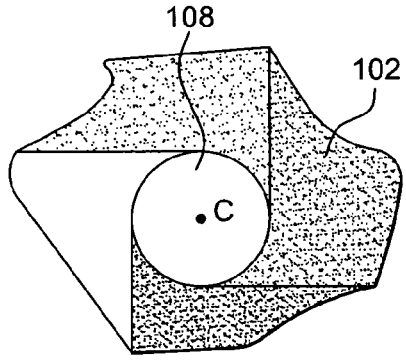

FIGS. 4*a* and 4*b* show another exemplary embodiment of the diaphragm 101 of the invention. One end of the side 109 of the triangular section of each jaw 102 is rounded. A radius of curvature of the rounded end is directed toward the center C of the diaphragm 101. Thus, as shown in FIG. 4*b* for a small diameter of aperture of the diaphragm 101, the section of the aperture 108 is circular. The crimping obtained for this circular section is perfectly sealed, since it obliges the sleeve 301 to follow a contour of the sheath 201.

For greater diameters of aperture of the diaphragm 101, a polygon is obtained with its four angles rounded as shown in FIG. 4*a*. The length L of the straight parts of the rounded sides 109 of the jaws 102 increases with the diameter of aperture of the diaphragm 101.

In a particular exemplary embodiment of the invention, the crimping device 100 can be provided with means to check the crimping of the sleeve 301 on the sheath 201 (not shown in the figures). For example, each jaw 102 can be provided with a sensor of a force exerted on said jaw 102. Each jaw 102 can also be provided with a sensor of the shift of the jaw 102 relative to the center C of the diaphragm 101. The shift of the jaw 102 can thus be checked as a function of the force exerted on said jaw 102. If the shifting of the jaw 102 does not correspond to the expected shift for the force exerted on the jaw 102, the crimping of the sleeve 301 on the sheath 201 may be faulty.

The crimping device of the invention can therefore be used to ensure tight-sealed crimping of the sleeve of a contact on the sheath of an electrical cable, especially as a complement to an electrical crimping of the sleeve on the strands of the cable. The connection between the contact and the electrical cable according to the invention is perfectly sealed. The same crimping device according to the invention enables the crimping of a large number of sleeves of different diameters on sheaths of electrical cables of different diameters.

What is claimed is:

1. A device for crimping a sleeve of a contact on an electrical cable, wherein the device comprises:

a cam-based device including a hollow rotatable cylinder, a first set of cams located at a first position along a longitudinal axis of the cylinder and positioned on an internal contour of the cylinder, and a second set of cams located at a second position along the longitudinal axis of the cylinder which is offset from the first position, the second set of cams being rotationally offset relative to the first set of cams and positioned on the internal contour of the cylinder; and a diaphragm including a plurality of jaws having a first subset of jaws and a second subset of jaws, wherein the plurality of jaws of the diaphragm is housed at least partially within the cylinder, wherein an external face of each jaw of the first subset of jaws comprises a boss adapted to contact a cam in the first set of cams, and each jaw of the second subset of jaws comprises a boss adapted to contact a cam in the second set of cams, the bosses of the first subset of jaws being only rotationally offset to the cylinder and only longitudinally spaced along the axis of the cylinder with respect to the bosses of the second subset of jaws, and wherein the first subset of jaws is operably engaged with the first set of cams and the second subset of jaws is operably engaged with the second set of cams such that as the cylinder is rotated, the jaws slidably move relative to one another and relative to the cylinder such that an aperture within the jaws is changed in size, and wherein the first subset of jaws and the second subset of jaws crimp the sleeve against the electrical cable when the cylinder is rotated to decrease the size of the aperture.

2. The device according to claim 1, wherein each jaw comprises a generally triangular section.

3. The device according to claim 2, wherein at least one side of each jaw having a triangular section has a rounded end, a radius of curvature of the rounded end directed towards a center of the diaphragm.

4. The device according to claim 1, comprising at least eight jaws.

5. The device according to claim 4, comprising at least twelve jaws.

6. The device according to claim 1, comprising a control device operable to control the aperture of the diaphragm.

7. The device according to claim 6, wherein the control device operably actuates the cam-based device for an electrical crimping of the contact on the cable.

8. The device according to claim 1, comprising means for checking the crimping of the contact on the cable.

9. The device according to claim 8, wherein the means for checking the crimping comprise at least one sensor of crimping forces as a function of a shift of the jaws.

10. The device according to claim 1, wherein the first set of cams is in quincunxial arrangement to the second set of cams.

11. The device according to claim 1, wherein the diaphragm comprises an even number of jaws.

12. The device according to claim 11, wherein alternate jaws comprise a boss adapted to contact a cam in the first set of cams, and wherein an adjacent jaw to each alternate jaw comprises a boss adapted to contact a cam in the second set of cams.

13. The device according to claim 1, wherein the cylinder of the cam-based device is adapted to rotate in a first direction to shift the plurality of jaws towards a center of the diaphragm, and the cam-based device is adapted to rotate in a second direction to shift the plurality of jaws away from the center of the diaphragm.

* * * * *